United States Patent [19]

Schiff

[11] 4,287,868

[45] Sep. 8, 1981

[54] RETRACTING ARROW REST

[76] Inventor: Charles M. Schiff, 976 S. Rifle, Aurora, Colo. 80012

[21] Appl. No.: 159,877

[22] Filed: Jun. 16, 1980

[51] Int. Cl.[3] ..... F41B 5/00

[52] U.S. Cl. ..... 124/41 A; 124/24 R

[58] Field of Search ..... 124/41 A, 1, 24 R, 86, 124/88

[56] References Cited

U.S. PATENT DOCUMENTS 2,975,780 3/1961 Fisher ..... 124/41 A X 3,504,659 4/1970 Babington ..... 124/41 A X

*Primary Examiner*—Richard C. Pinkham

*Assistant Examiner*—William R. Browne

*Attorney, Agent, or Firm*—Bruce G. Klaas

[57] ABSTRACT

An arrow rest, movable to clear fletching on an arrow released from a bow includes a pivotal arrow rest pivoting to an upright arrow holding position for drawing the bow, and lowered to arrow clearing position, having a triggering control attached to an end portion of the bow responsive to movement of the bow limb after arrow release for moving the arrow holding assembly from the upright position to the lowered position. The triggering control includes a controllable counterweight, for adjusting the timing of arrow holding release.

9 Claims, 4 Drawing Figures

RETRACTING ARROW REST

BACKGROUND OF THE INVENTION

1. Field of the invention

The present invention relates to archery bows and, more particularly, to a retractable arrow rest device, used in such bows, which moves clear of an arrow being released from the bow string to prevent deflection of the arrow by the feathers, or fletching, on the arrow contacting the arrow rest.

2. Prior art

In U.S. Pat. No. 2,975,780, issued Mar. 21, 1961, to Fisher, a disappearing arrow rest which uses a string connected to one end of a bow is disclosed. The string exerts tension on the arrow rest to move it out of position unless the bow is flexed.

In U.S. Pat. No. 3,504,659, issued Apr. 7, 1970, to Babington, an arrow rest is disclosed with pivots out of the path of the arrow and is held in an upright position by the force of an elastic band attached to the bow string and tensed when the bow string is drawn.

In these arrangements, the arrow rest is not positioned for holding the arrow unless the bow is drawn, or no timing control is used to control the arrow rest release.

Accordingly, it is an object of the present invention to provide an arrow rest which moves clear of the fletching of a released arrow, and can be positioned to support an arrow without tension on the bow.

It is another object of the present invention to provide a movable arrow rest which is responsive to forward inertia of the bow.

It is a further object of the present invention to provide a movable arrow rest which can be adjusted as to timing of its movement.

SUMMARY OF THE INVENTION

These and other objects are accomplished by an arrow rest device which comprises an arrow holder assembly pivotably connected to the bow; positioning means connected to the arrow holder assembly for pivotally positioning an arrow rest, comprised in the arrow holder assembly, in either an upright, arrow holding position, or a lowered, fletching and arrow clearing position, when actuated by triggering means during shooting of an arrow. The triggering means comprises a pivotable, adjustable counterweighted lever arm attached to one end of the bow, the lever arm being pivoted by inertia from forward movement. The lever arm is connected by an actuating cable to the arrow holder assembly for moving the arrow holder assembly to the lowered, arrow clearing, position.

The pivotable arrow holder assembly has an arrow rest mounted on a shaft extending outwardly from the bow, adjacent the hand-hold, connected through a lever arm to the cable. A counter weighted inertial actuator actuates the cable to pivot the arrow rest before the arrow fletching reaches the arrow rest (on release of the bow string).

DESCRIPTION OF THE PREFERRED EMBODIMENT

Figure 1:
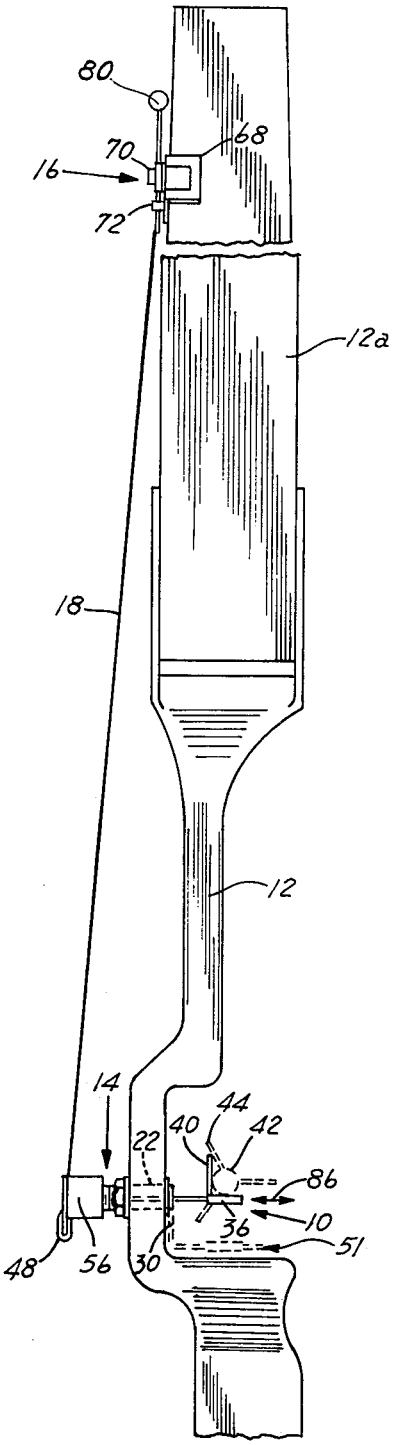
FIG. 1 is a front view of an arrow rest device, according to the present invention, mounted on a bow which is shown in partial view.
Figure 2:
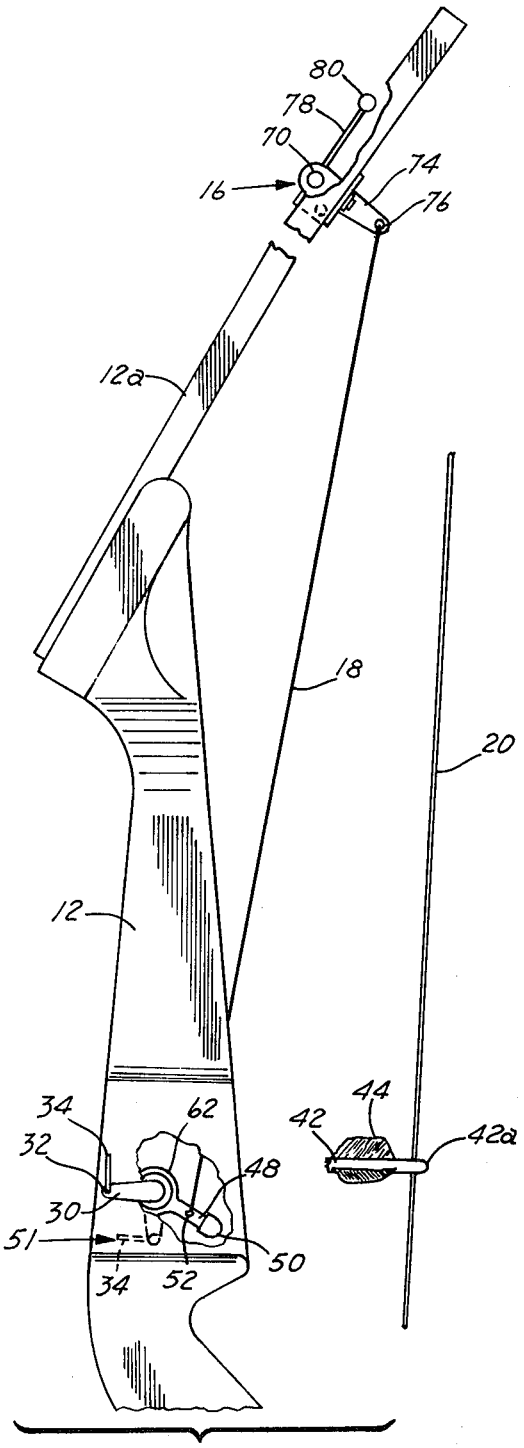
FIG. 2 is a side elevational view of the device of FIG. 1.

Referring now to FIGS. 1 and 2, the present device may be seen to comprise, in general, an arrow holder assembly (sometime called an arrow rest) (shown generally by numeral 10) pivotably mounted to the hand-hold or handle portion of a bow 12, positioning means (shown generally by numeral 14) mounted on the opposite side of the bow from the arrow holder assembly, and triggering means (shown generally by 16) attached adjacent the outer end portion of the bow limb 12*a*. The bow used may be either left-handed or right-handed, a long bow, a recurved bow, a compound bow or other kind of bow. The arrow holder assembly 10 is pivotal between an upright arrow holding position indicated in solid lines in FIG. 1, and a lowered, arrow clearing position, as indicated by the broken lines in FIGS. 1 and 2. The positioning means 14 are connected to the arrow holder assembly by a rotatable shaft to position an arrow holding portion of the assembly between the upright arrow holding position and the lowered arrow clearing position. The triggering means 16 is connected to the positioning means 14 by an actuating cable 18, which triggers the lowering of the arrow holding portion by the force of inertia imparted to the triggering means by the forward movement of the bow limb, on release of the bow string 20, partially shown. As shown in FIGS. 1 and 2, the triggering means is located very near or at the end of the bow limb 12*a*.

ARROW HOLDER ASSEMBLY

Figure 4:
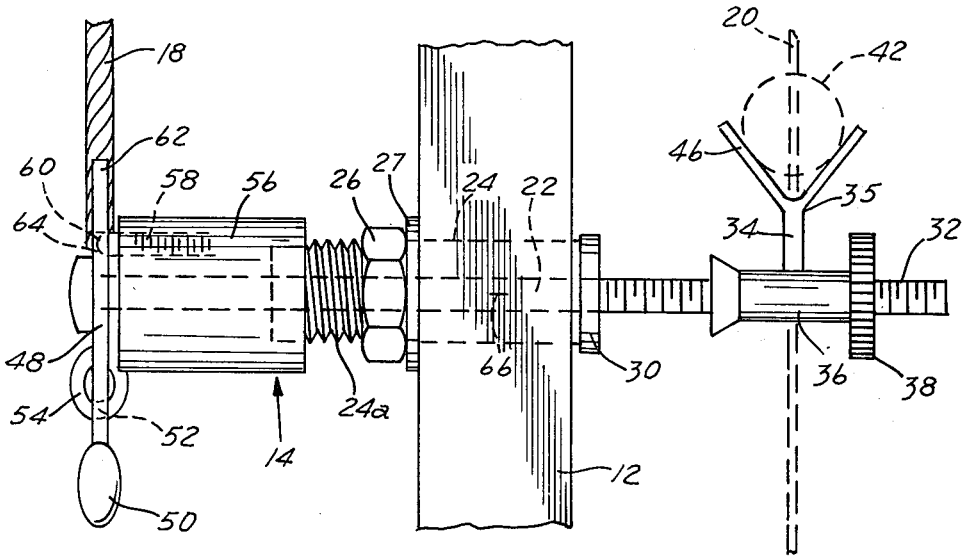
FIG. 4 is an enlarged detailed view of the arrow holder means of FIG. 1.

The arrow holder assembly, FIG. 4, is mounted on a pivotal shaft 22 that extends through the bow 12, the shaft 22 is rotatably held in a sleeve 24 (extending through the bow) fastened in position by a nut 26 on a threaded portion 24*a* of a brass sleeve 24. The shaft is positioned by apertured washer 27, positioned by the nut 26 pulling against a lever portion 30 on the opposite side of the handle.

On one side of the bow, the lever 30 is mounted on the pivotable shaft 22 providing an offsetting lever portion extending radially outwardly from the pivot shaft in a bow forward direction. At the outer end of the offsetting lever portion 30, a threaded connecting member shaft 32 extends laterally of the lever supporting thereon a preferred form of an arrow rest 34 mounted on wind adjustment a threaded cylindrical member 36, arranged to laterally position the arrow rest 34. A thumbwheel 38, also, threadedly mounted on the connecting member shaft 32, secure it in its adjusted lateral position with respect to the bow, and its vertical orientation of the arrow rest 34.

The arrow rest 34, in the form shown in FIG. 1, comprises an upright member 40 attached to the cylindrical member 36, whereby an arrow 42 may rest on the cylindrical member 36 and against the upright member 40. The fletching at the noch end of the arrow may be positioned as shown at 44 or any other position. An alternative embodiment is shown in FIG. 4, wherein the arrow rest 34 includes an upstanding portion 35 and a bifurcated arrow support 46, of sufficient size in which an arrow may rest.

On the outside of the bow, the pivotable shaft 22 extends laterally outwardly from the bow and a cocking lever arm 48 is fixedly mounted on the shaft 22 for moving the arrow rest from its upright arrow holding position to the lowered, arrow clearing, position when the pivotable shaft 22 is rotated. The cocking lever arm 48 terminates in a rubber (or other protector) tip portion 50. An aperture 52 is formed in lever arm 48 for receiving a loop 54 which is connected to the actuating cable 18. The rubber tip portion 50 facilitates hand positioning of the cocking arm 48, in wet, cold weather, or the like.

POSITIONING MEANS

The arrow rest positioning means 14 comprises a simple, spring-ball detent mechanism, comprising a block 56 attached to the bushing 24. The block 56 includes a central aperture through which the pivotable shaft 22 freely extends. An offset aperture is bored in the block for a coil spring 58 which forces outwardly a ball 60 against a hub portion 62 of the cocking arm 48. The hub 62 includes at least two apertures 64 which move into and out of contact with the ball 60 as the cocking arm rotates about axis 66 of the shaft. As the ball 60 enters an aperture 64, the cocking arm 48, and interconnected pivotable shaft 22 and arrow rest 34, is held in a position.

TRIGGERING MEANS

Figure 3:
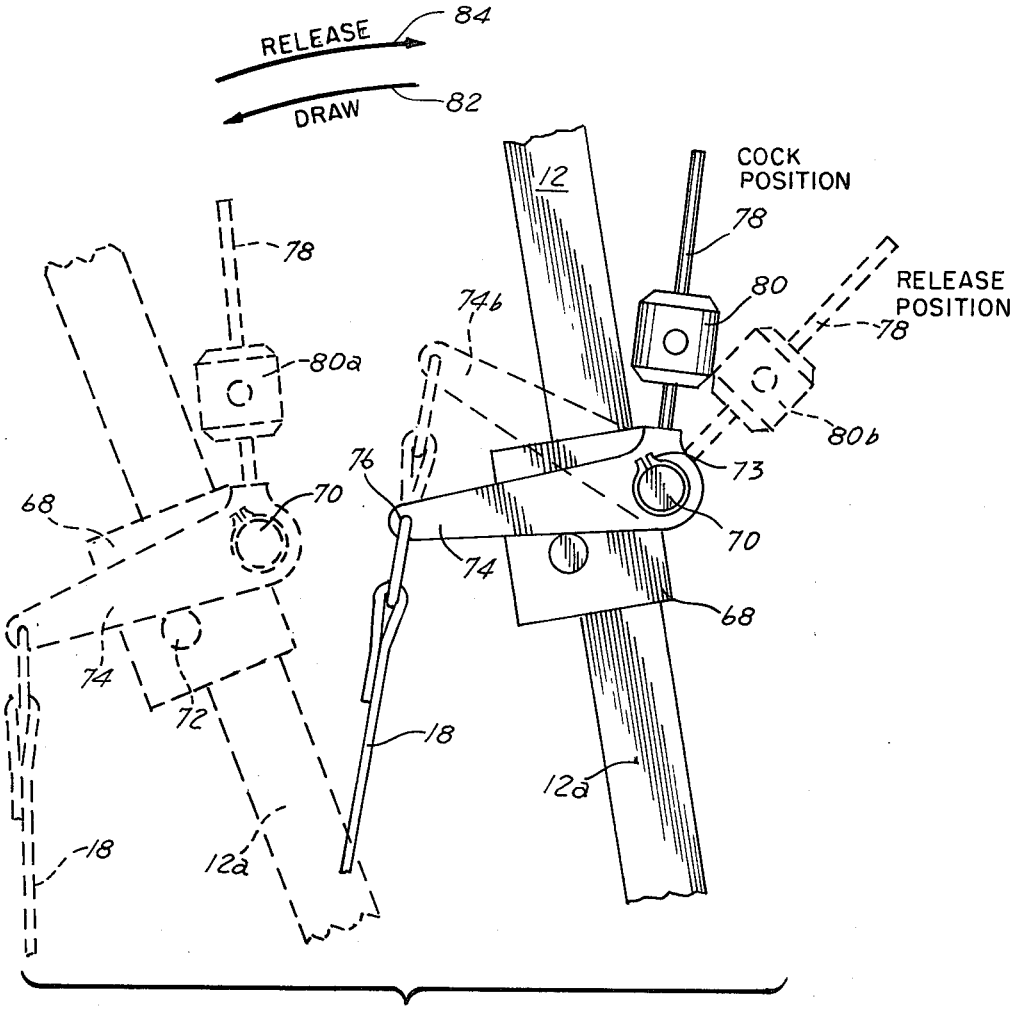
FIG. 3 is a detailed view of a triggering means of FIGS. 1 and 2, in cocked and release positions.

The triggering means 16, as shown in detail in FIG. 3, are mounted adjacent an end portion of the bow limb by a bracket 68. The bracket 68 includes an aperture for rotatably holding a shaft 70, and a stop 72 extending laterally away from the bow.

A lever arm 74 is pivotably mounted on the shaft 70 and held by snap ring 73. The lever arm extends rearwardly of the bow, with an aperture 76 adjacent its end to which the actuating cable 18 is attached. The stop 72 is rearwardly and downwardly offset from the shaft 70, for stopping the lever arm and holding in a rest position. A counter weight holding shaft 78 is secured to and extends upwardly from the arm 74, normal to the arm 74. A counterweight 80 is adjustably mounted on the shaft 78 and may be held by a set screw or the like extending through the counterweight to the stem.

As shown in phantom, FIG. 3, the counterweight **80*a* cocked by moving it rearwardly of the bow limb which releases the cable and permits the arrow rest to be raised into arrow holding position by pushing down lever 48. When the string 20 of the bow is drawn back, the bow limbs tend to curve rearwardly of the bow. The bow is drawn, shown by arrow 82. When the string 20 and arrow nock 42*a* thereon are released, the bow limbs move forward (to their normal position), as shown by arrow 84, to the bow limb position shown in solid lines in FIG. 3. Inertia of the counterweight, in the direction of arrow flight, causes the counterweight to continue to move forward from the cable release position when the bow limbs return to normal position, to the position indicated by 80*b*, forward of bow limb 12*a*. This pivots the arm 74 upwardly pulling the cable 18** upwardly.

As seen in FIG. 2, when the actuating cable 18 is pulled upwardly, the lever 30 and the arrow rest 34 pivots from an upright position downwardly (in the direction of the arrow flight) to a lowered position as shown at 51. The pulling of the actuating cable 18 causes rotation of the lever hub and one aperture for the ball detent is moved away from the ball detent and the other aperture onto the detent for temporarily holding the shaft 22. The apertures are positioned so that the ball detent temporarily holds the arrow rest up or down. As shown in FIG. 1, the cocking arm 48 is used to set the detent mechanism in the position for the arrow rest.

The arrow rest may be adjusted for windage in the direction of arrow 86 (FIG. 1) by threading the cylindrical member 36 toward and away from the bow. The thumbwheel 38 is threadedly mounted on member 32. An arrow 42 is placed on the arrow rest, the string and arrow are drawn back and released, causing the trigger mechanism to pull actuating cable 18 to rotate the pivotable shaft 22 pivoting the arrow rest into the lowered position as shown in 51.

The counterweight trigger is in its at rest position, with the cable slack, for nocking an arrow on the bow string. The arrow rest is rotated to the up position. With the arrow on the rest and nocked, the string is pulled to the position of maximum pull for the length of arrow being used. Upon release of the bow string, the trigger (counterweight) maintains its relative position to the bow limb. The flexed tension of the bow limbs causes them to unbend toward their natural atrest position. The unbending accelerates toward the natural position pulling the string forward carrying the arrow at an accelerating rate. When the bow limbs reach their atrest position, they essentially stop. At this point the arrow leaves the string, and has its maximum speed. When the bow limb stops, the attached counter weight continues its movement, but rotates around the trigger shaft 70 pulling up on the lever arm 74 and the cable. The cable pulls up the arrow lever rotating the arrow rest downwardly out of the path of the arrow and its fletching. At this point most of the arrow's length extends beyond the bow in its flight. The weight may be moved on the shaft to changed the sensitivity of the trigger and to change the pull on the cable and the timing of the arrow rest retracting.

Thus, there has been provided an arrow rest device which may be easily retrofited to existing bows, and may be adjusted with regard to the timing of the displacement of the arrow rest, providing means for adjusting the arrow rest for windage, and, also, positionable without the necessity for tension on the bow.

What is claimed is:

1. An arrow rest device movable from an arrow supporting position to a position to clear fletching on an arrow released from a bow, comprising:

(a) an arrow holder assembly adapted to be mounted on a bow said assembly including an arrow rest (b) positioning means connected to said arrow holder assembly for positioning said arrow rest from upright arrow holding, position when the bow is not drawn, to a lowered, arrow clearing, position when a drawn bow string is released (c) triggering means adapted to be attached to an end portion of a limb of a bow, responsive to movement of a bow limb after arrow release, for moving said arrow holder assembly from said upright position to said lowered position in response to said movement of a bow limb, inclusive of a shaft adapted to be mounted on said end portion of a bow limb and a pivotal arm extending radially from said shaft and pivotable relative to a bow, weight means associated with said pivotal arm and movable in response to movement of a bow limb and cable means interconnecting said arrow holding assembly and pivotal arm whereby movement of said weight means pivots said pivotal arm pulling on said cable means to pivot said arrow rest to said lowered position.

2. The device of claim 1 further comprising:

an adjustable weight means associated with said pivotal arm for adjustably inertially moving said pivotal arm.

3. The device of claim 1 wherein said weight means is mounted on a shaft normal to said pivotal arm and is securable in an adjustable position thereon.

4. The device of claim 1 or 2 wherein said arrow holder assembly comprises:

a pivotable shaft adapted to extend through a bow, a level arm mounted on said shaft, said arrow rest being fixedly mounted on said shaft and pivotal therewith.

5. The device of claim 4 further comprising:

said lever arm being mountable on a side of a bow opposite from said arrow rest;

said pivotable shaft extending through said positioning means and terminating in a lever portion extending radially therefrom for connection to said triggering means.

6. The apparatus of claim 5 wherein said arrow rest is mounted on a threaded holder and said pivotable shaft is threaded providing said arrow rest transversely of a bow for windage.

7. The apparatus of claim 1 wherein said arrow rest is an upstanding Y member.

8. The apparatus of claim 1 wherein a spring detent temporarily holds said arrow rest in either up or down position.

9. The apparatus of claim 1 wherein said arrow rest is mounted on a lever arm and is arranged to pivot forwardly and downwardly of a bow.

* * * * *